US006666761B2

(12) United States Patent
Nyström

(10) Patent No.: US 6,666,761 B2
(45) Date of Patent: Dec. 23, 2003

(54) WALL-MOUNTED SUPPLY-AIR DEVICE

(75) Inventor: Bernt Nyström, Stockholm (SE)

(73) Assignee: Air Innovation Sweden AB (SE)

( * ) Notice: Subject to any disclaimer, the term of this patent is extended or adjusted under 35 U.S.C. 154(b) by 0 days.

(21) Appl. No.: 10/182,686

(22) PCT Filed: Jan. 22, 2001

(86) PCT No.: PCT/SE01/00109

§ 371 (c)(1),
(2), (4) Date: Oct. 4, 2002

(87) PCT Pub. No.: WO01/55648

PCT Pub. Date: Aug. 2, 2001

(65) Prior Publication Data

US 2003/0114100 A1 Jun. 19, 2003

(30) Foreign Application Priority Data

Jan. 27, 2000 (SE) ..... 0000250

(51) Int. Cl.[7] ..... F24F 13/18
(52) U.S. Cl. ..... 454/322; 454/330; 454/333
(58) Field of Search ..... 454/185, 186, 454/322, 333, 330

(56) References Cited

U.S. PATENT DOCUMENTS 429,968 A * 6/1890 Schauck ..... 454/322
486,865 A * 11/1892 Foster ..... 454/322
1,786,331 A * 12/1930 Besch ..... 454/328
2,011,141 A * 8/1935 Bergstrom ..... 454/322
2,284,912 A * 6/1942 Maynard et al. ..... 454/333
2,311,195 A * 2/1943 Young ..... 49/343
4,136,606 A 1/1979 Wolbrink ..... 98/33

FOREIGN PATENT DOCUMENTS

DE 1 965 488 * 7/1970 ..... 454/322
EP 0694151 10/1999
GB 494899 10/1938
GB 2218196 11/1989
SE 227 124 * 8/1969 ..... 454/330

OTHER PUBLICATIONS

Patent Abstracts of Japan, abstract of JP, 53–15556 A (Matshita Denki Sangyo K.K.) Aug. 25, 1979, see abstract, figures.

* cited by examiner

*Primary Examiner*—Harold Joyce
(74) *Attorney, Agent, or Firm*—Ostrolenk, Faber, Gerb & Soffen, LLP

(57) ABSTRACT

A wall-mounted supply-air device comprising an upper valve part connected to an upper edge of an aperture in a primary wall side and a lower valve part connected to a lower edge of the aperture in the wall side, the supply air to the device being arranged to be supplied downwardly to the inlet side of the device, between the primary wall side and a secondary wall side in connection with the primary wall side.

11 Claims, 1 Drawing Sheet

WALL-MOUNTED SUPPLY-AIR DEVICE

TECHNICAL AREA

The present invention relates to ventilation and to a supply-air device designed to be applied in a wall opening.

BACKGROUND ART

EP-B1-0 694 151 shows a method and a device for introducing ventilation air into a ventilated space by supplying air from a supply-air device downwardly along a wall, the air thereafter following the wall down due to the Coanda effect, being deflected at the floor and then spreading along the floor, whereupon air in the ventilated space is removed in the ceiling zone. The supply-air device is applied on the wall with its air passage vertical and its supply-air outlet directed downwardly.

OBJECT OF THE INVENTION

The object of the invention is to provide an improved supply-air device on a wall, of the type permitting air to be supplied to a ventilated space at a distance above floor level and to subsequently flow downwardly along the wall due to the Coanda effect, being thereafter deflected and spread out over the floor.

SUMMARY OF THE INVENTION

The object of the invention is fulfilled by the invention having acquired the features defined in the claims. A suitable placing for a supply-air device of the present type is achieved by arranging said device in a preferably rectangular wall opening placed about 30–160 cm, preferably 70–120 cm above the floor, either in an outer wall or a partition wall. Also arranging this supply-air device with guiding surfaces that give the air flow a relatively narrow angle from the wall down towards the floor utilizes the Coanda effect according to which the flow of air has a tendency to attach itself to and accelerate down along the wall towards the floor. Thanks to this acceleration the clean air supplied at floor level is spread extremely well. The air supplied gradually mixes with and displaces the "used" air from floor level and up through the room to an exhaust-air device near the ceiling so that the entire room is ventilated in an optimal manner. The configuration of the supply-air device comprises a recess so that the device can be inserted in the wall opening and displaced vertically over the wall part, after which the device is secured. The device is thus assembled after the wall part is in place, by sawing a rectangular opening in the wall and then fitting the device. The device may either be made in one piece or as two separate parts in the form of an upper and a lower part. To achieve optimal air flow down towards the floor the angle between the vertical plane and the control device of the supply-air device shall be within the interval 10°–45°, preferably 20°–25°. The control device extends in the wall section from one wall part to the inside of the other, opposite wall part in order to limit the space between the wall parts and obtain deflection of air entering from above and passing out through the opening. The inner, upper end of the lower part of the supply-air device is preferably provided with a flexible contact edge against the opposite wall part. If the upper and lower valve parts of the supply-air device are connected with end pieces, a suitable embodiment comprises allowing a supply-air duct to be connected to the inlet side of the supply-air device. The supply-air device is also provided with a damper to regulate the amount of fresh air supplied by adjusting the throttling in the device via an actuator. The wall opening may be a shape other than rectangular, e.g. circular or oval, depending on the aesthetic design of the supply-air device.

BRIEF DESCRIPTION OF THE DRAWINGS

The invention will now be described in more detail with reference to the accompanying drawings.

DESCRIPTION OF THE INVENTION

Figure 1:
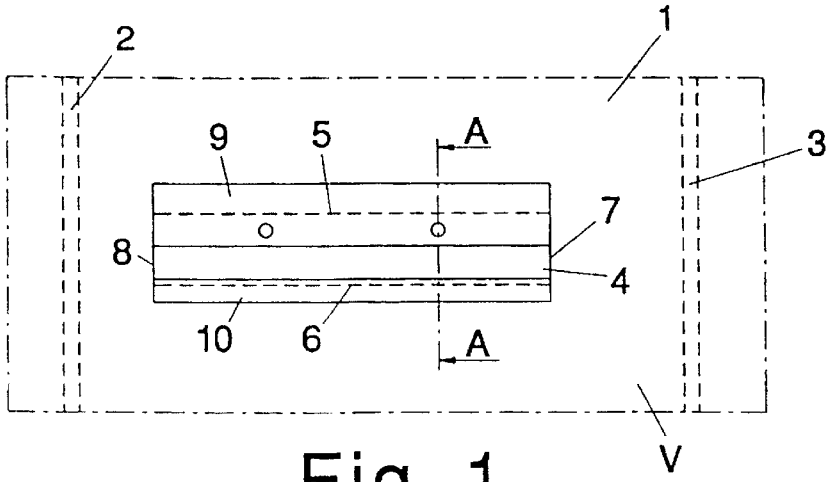
FIG. 1 shows a part of an inner wall provided with a supply-air device in accordance with the invention.

FIG. 1 shows a supply-air device in accordance with the invention, which supply-air device is fitted in a wall section 1 forming an inner partition wall. The wall section is constructed in conventional manner out of vertical studs 2, 3 onto which plasterboards are attached on both sides. The wall section is thus constructed, enclosing a number of air volumes V between plasterboards and studs. The air volumes are used for supplying fresh air to one or more rooms, one or more air volumes being connected to fresh air via ventilation ducts, the air being fed down vertically through the volume by means of a fan arrangement. A rectangular aperture 4 is provided in the plasterboard of one wall side, said aperture being defied by an upper edge 5, a lower edge 6 and two side edges 7, 8. The supply-air device comprises an upper valve part 9 connected to the upper edge 5 of the aperture 4, and a lower valve part 10 connected to the lower edge 6 of the aperture 4.

Figure 2:
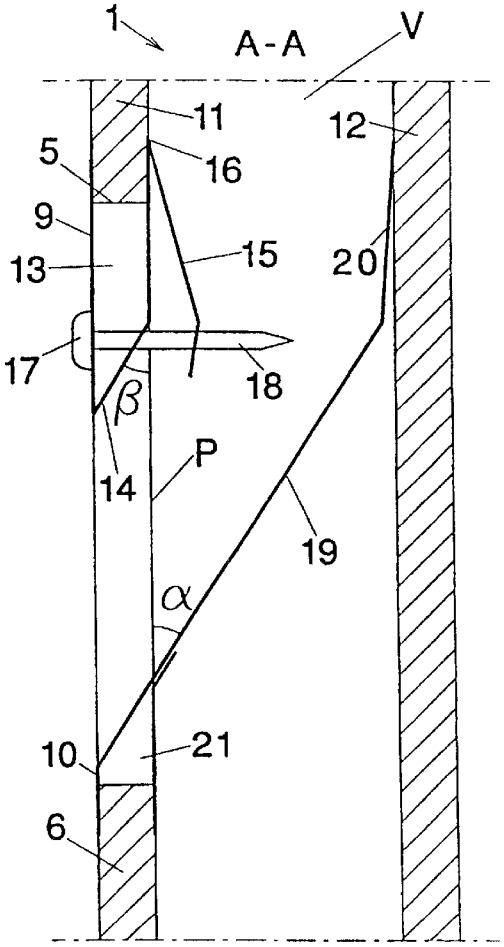
FIG. 2 shows in a section A—A a first embodiment of a supply-air device in accordance with the invention.

FIG. 2 shows a section A—A through a first embodiment of a supply-air device in accordance with the invention, the device 9, 10 being fitted in a wall section 1 consisting of a primary wall side 11 and a secondary wall side 12 parallel therewith, both of which consist of simple plasterboards. According to the figure the device 9, 10 is fitted in the primary wall side 11. The device shown in FIG. 2 consists of two separate parts, the upper valve part 9 having a gap 13 with a width corresponding to the thickness of the primary wall side 11. The gap is open at both ends and the complete upper valve part 9 of the device can therefore be displaced vertically over the upper edge 5 of the primary wall side 11. The extension in vertical direction of the upper valve part 9 is less than the vertical extension of the aperture. The lower part of the valve part 9 is provided with a first air control device 14 in the form of a flat surface that forms an angle $\beta$ between the vertical plane P through the valve part, which angle $\beta$ lies within the interval 10°–45°, preferably 20°–25°. The purpose of this inclined surface is to deflect an air flow coming from the air volume V above, out through the wall opening. The upper valve part 9 is also provided with a damper 15 connected by its upper end to the inner upper end of the valve part by means of a hinge 16. The free end of the damper 15 is also connected to a regulator 17 via a threaded shaft 18 extending through both the upper valve part 9 and the damper 15. Turning the regulator produces a change in the angle of the damper 15 which in turn results in the air flow being either throttled or opened.

The lower valve part 10 is also provided with a second air control device 19 arranged at an angle $\alpha$, to said vertical plane P. The second air control device 19 extends from the primary wall side 11 to the secondary walls side 12 and terminates in a flexible contact edge 20. The angle a also lies within the interval 10°–45°, preferably 20°–25°. The angles α and β need not be equal, however, although this is usually the case. The air volume V through the second air control device 19 is thus limited to a length corresponding to the length of the rectangular aperture 4. Thus the whole volume of air is not necessarily restricted since the rectangular aperture is shorter than the distance between the two studs 2, 3. Neither is this necessary since the most important factor is to obtain a downwardly directed air flow on the outside of the wall in order to utilize the Coanda effect. The second air control device 19 is also provided with a gap 21 to allow its insertion over the lower edge 6 of the wall part.

The device is mounted by the upper and lower valve parts 9, 10 being inserted one at a time through the rectangular aperture and over the primary wall side 11 to the correct vertical position, and then fixed to the wall side.

Figure 3:
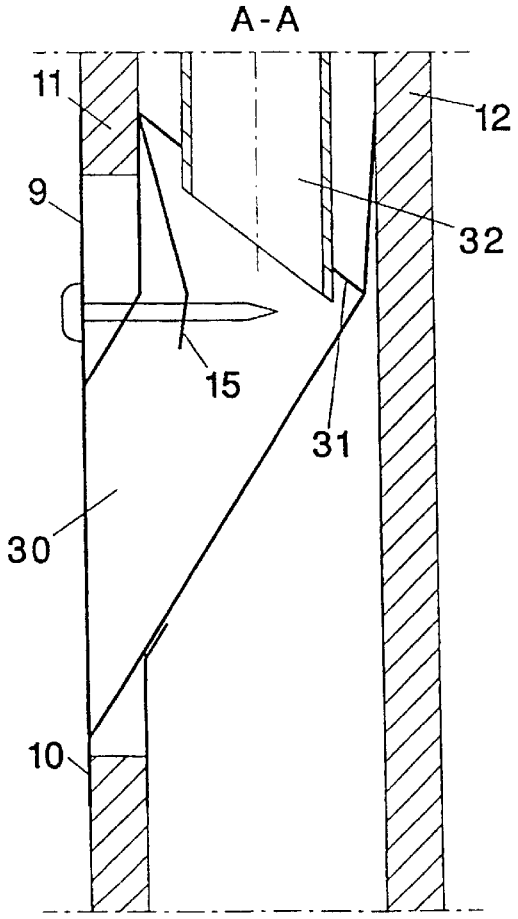
FIG. 3 shows in a section A—A a second embodiment of a supply-air device in accordance with the invention.

FIG. 3 shows a second embodiment of the present invention. The components in the supply-air device also to be found in FIG. 2 are identical. Additional features are that the supply-air device is provided with end pieces 30 connecting the upper valve part 9 with the lower valve part 10. The damper 15 is thus able to move freely from these end pieces. Since these end pieces connect the valve parts 9, 10, the supply-air device forms a volume which is covered at the top by a connection plate 31 and is downwardly completely open to the space. This embodiment is also provided with a supply-air duct 32 located centrally between the wall sides 11, 12. This supply-air device is mounted by inserting the complete device through the rectangular aperture, the supply-air duct 32 being guided in through the hole in the connection plate 31. The device is pushed up over the primary wall side 11 and then down to its correct vertical position in the rectangular aperture, where the device is then fixed.

What is claimed is:

1. A wall-mounted supply-air device for supplying air to a ventilated space, comprising an upper valve part (9) connected to an upper edge (5) of an aperture (4) in a wall section (1) consisting of a primary wall side (11) and a secondary wall side (12) parallel therewith and a lower valve part (10) connected to a lower edge of the aperture (4) in the wall side (11), characterized in that, both the upper and the lower valve parts (9, 10) are provided with a gap (13, 21) arranged so that each valve part can be displaced vertically over the edges (5, 6) of the aperture (4), the supply air to the device is arranged to be supplied downwardly to the inlet side of the device, between the primary wall side (11) and a secondary wall side (12) and that surfaces are arranged to guide the air flow along the wall down towards the floor.

2. A supply-air device as claimed in claim 1, characterized in that the upper valve part (9) is constructed with a first air control device (14) arranged at an angle β, within the interval 10°–45°, to an imagined vertical plane (P) through the supply-air device in order to deflect an air flow out through the aperture (4).

3. A supply-air device as claimed in claim 1, characterized in that the lower valve part (10) is constructed with a second air control device (19) arranged at an angle α, within the interval 10°–45°, to an imagined vertical plane (P) through the supply-air device in order to deflect an air flow out through the aperture (4).

4. A supply-air device as claimed in claim 1, characterized in that the upper valve part (9) is provided with a damper (15) arranged hinged at its upper end on the inner side of the valve part (9).

5. A supply-air device as claimed in claim 4, characterized in that the damper (15) is arranged to be regulated by means of a regulator (17) passing through the upper valve part for changing the angle of the damper (15) in relation to the vertical plane (P).

6. A supply-air device as claimed in claim 1, characterized in that the supply-air device (19) of the lower valve part (10) is provided at its upper, inner end with a flexible contact edge (20).

7. A supply-air device as claimed in claim 1, characterized in that the upper and the lower valve parts (9, 10) are joined by spacers.

8. A supply-air device as claimed in claim 7, characterized in that the spacers comprise end pieces (30) at both ends of the valve parts (9, 10).

9. A supply-air device as claimed in claim 8, characterized in that the connecting plate (31) covers the upper end of the supply-air device.

10. A supply-air device as claimed in claim 1, characterized in that the supply-air channel (32) is connected to the inlet side of the supply-air device.

11. A supply-air device as claimed in claim 1, characterized in that the supply-air device is mounted in a rectangular aperture (4) situated in the primary wall side (11) that is parallel with the secondary wall side (12) so that the supply-air device is in connection with said secondary wall side (12).

* * * * *